United States Patent [19]

Thalenfeld et al.

[11] Patent Number: 4,688,683

[45] Date of Patent: Aug. 25, 1987

[54] ADJUSTABLE MERCHANDISE DISPLAY HOOK ASSEMBLY FOR APERTURED PANELBOARD

[75] Inventors: David R. Thalenfeld, Bear Creek, Pa.; Mark E. Goldstein, Farmington; James A. Govang, Killingworth, both of Conn.

[73] Assignee: The Stanley Works, New Britain, Conn.

[21] Appl. No.: 905,637

[22] Filed: Sep. 10, 1986

[51] Int. Cl.[4] ..... A47F 5/00

[52] U.S. Cl. ..... 211/57.1; 248/220.4; 248/222.2

[58] Field of Search ..... 248/220.2, 220.4, 221.1, 248/220.3, 222.3, 225.2, 303; 211/59.3, 57.1, 54.1

[56] References Cited

U.S. PATENT DOCUMENTS

| | | | |
|---|---|---|---|
| 1,807,356 | 9/1928 | Vance . | |
| 2,291,966 | 4/1941 | Joseph . | |
| 2,754,974 | 11/1952 | Larson . | |
| 2,841,353 | 7/1953 | Burdick . | |
| 2,842,264 | 3/1955 | Larson . | |
| 3,198,469 | 8/1965 | Callanan | 248/220.4 |
| 3,279,620 | 2/1965 | Nesbitt . | |
| 3,908,949 | 9/1975 | Larson . | |
| 3,964,712 | 6/1976 | Staudte, Jr. . | |
| 3,976,201 | 8/1976 | Hodgson | 248/220.4 |
| 4,094,415 | 6/1978 | Larson . | |
| 4,155,459 | 5/1979 | Marschak | 248/220.4 |
| 4,286,764 | 9/1981 | Pfeifer | 248/220.3 |
| 4,308,961 | 1/1982 | Kunce . | |
| 4,351,440 | 9/1982 | Thalenfeld . | |
| 4,405,051 | 9/1983 | Thalenfeld . | |
| 4,405,110 | 9/1983 | Gibbons . | |
| 4,436,209 | 3/1984 | Thalenfeld | 211/59.1 |
| 4,441,619 | 4/1984 | Gibitz . | |
| 4,452,360 | 6/1984 | Barnes | 248/220.4 |
| 4,474,351 | 10/1984 | Thalenfeld . | |
| 4,502,602 | 3/1985 | Swanson | 248/220.4 |
| 4,509,648 | 4/1985 | Govang et al. . | |
| 4,512,481 | 4/1985 | Thalenfeld . | |
| 4,516,681 | 5/1985 | Jahel | 248/220.4 |
| 4,520,978 | 6/1985 | Taub | 248/220.4 |

FOREIGN PATENT DOCUMENTS

| | | | |
|---|---|---|---|
| 2758582 | 7/1979 | Fed. Rep. of Germany | 248/220.4 |
| 3335214 | 4/1985 | Fed. Rep. of Germany | 248/220.3 |
| 1483450 | 8/1977 | United Kingdom | 248/220.4 |

*Primary Examiner*—J. Franklin Foss
*Assistant Examiner*—Robert A. Olson

[57] ABSTRACT

A merchandise display hook assembly provides high density display of carded merchandise and the like on apertured panelboard display structures. The device includes a base member engageable with and supported by the apertured panel, and an adapter member which is slidably mounted on the base member for limited lateral sliding movement over a distance approximating a substantial portion of the center-to-center distance between apertures in the panelboard. A merchandise display hook element is removably seated on the adapter member to carry the merchandise. The laterally adjustable adapter member enables the hook to be adjusted laterally within the mounting area for the assembly as necessary to achieve high density utilization of the display area and without interference between adjacent displayed merchandise to avoid unnecessarily wide spacing between adjacent articles.

13 Claims, 9 Drawing Figures

FIG. 1
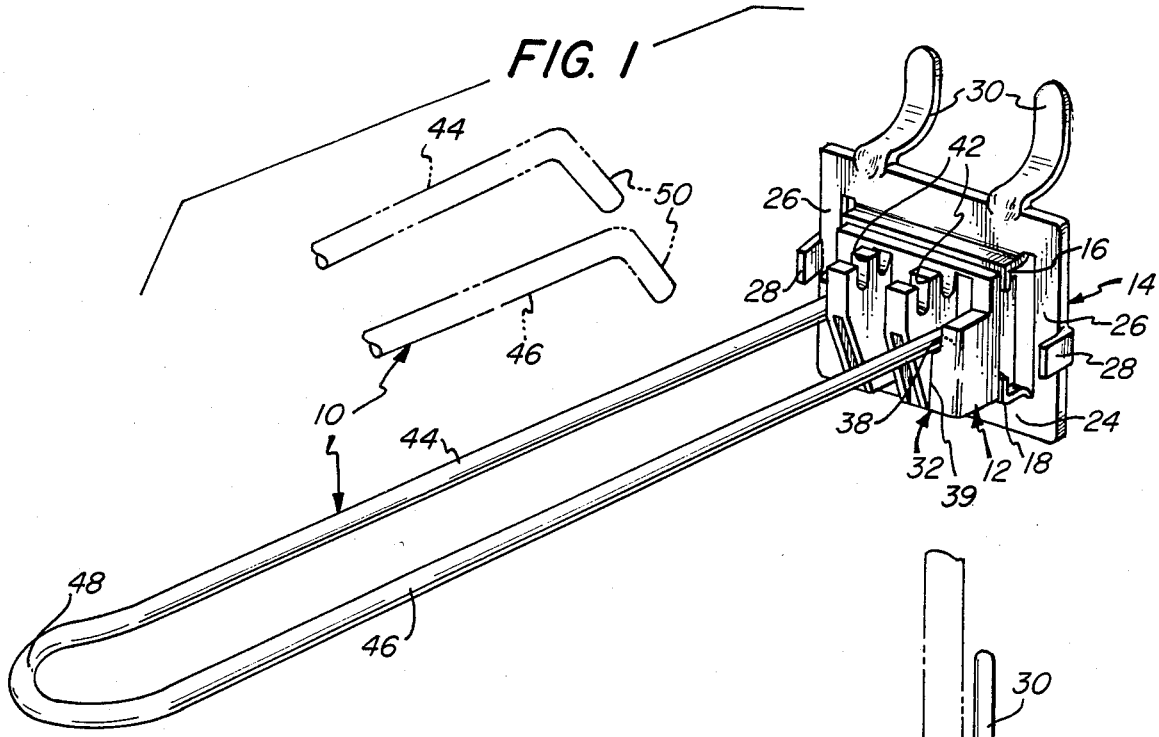
FIG. 2
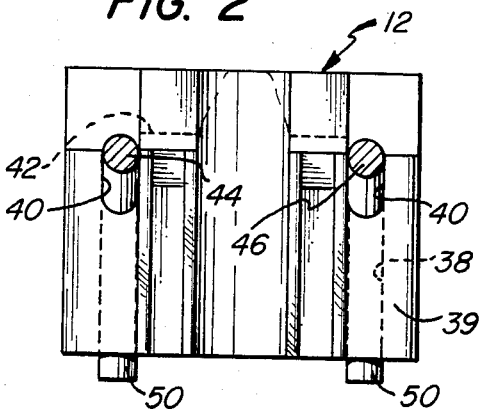
FIG. 4
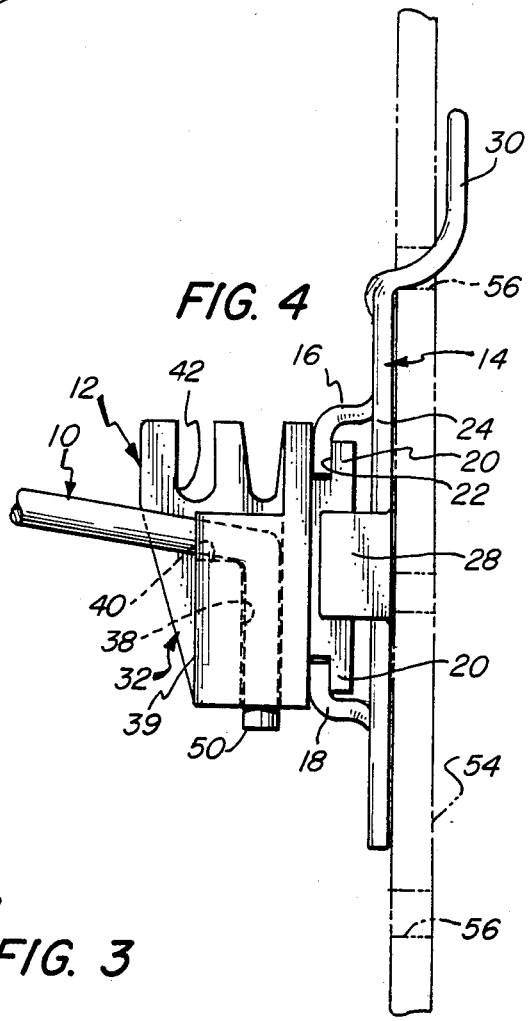
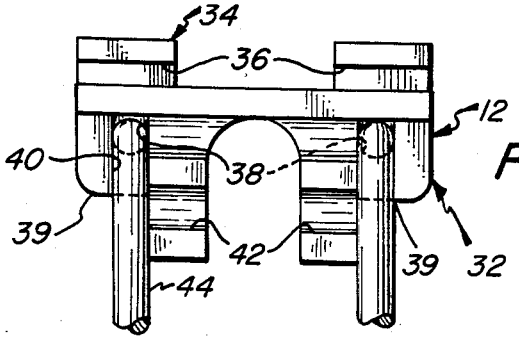
FIG. 3

ADJUSTABLE MERCHANDISE DISPLAY HOOK ASSEMBLY FOR APERTURED PANELBOARD

BACKGROUND OF THE INVENTION

The present invention is directed to merchandise display hook assemblies for use in the display of merchandise on apertured panelboard of the type commonly and widely used in mass merchandise retail outlets.

For wall displays of carded or otherwise prepackaged merchandise, it is common to utilize large expanses of apertured panelboard on which are mounted merchandise display hooks. Typically, such panelboard is provided with openings on one inch centers, both vertically and horizontally, to provide a great deal of flexibility in the manner in which the merchandise display hooks may be arranged and located to display the goods supported thereon.

Notwithstanding the apparent flexibility provided by locating apertures on one inch centers, it may still be difficult in some cases to achieve a desired degree of high density product display because of the diversity and nonstandardization of size and shape of the displayed products. Frequently, there are instances when a product, supported by a hook seated in one set of panel openings, may interfere with or be unduly close to adjacent display packages supported by the adjacent hook(s). Conventionally, one display hook is frequently moved one aperture (which may be further than necessary), and this may result in an inefficient use of valuable display area.

It is an object of the present invention to provide a novel merchandise display hook assembly which enables more efficient use of the display space of an apertured panelboard.

It is also an object to provide such a merchandise display hook assembly using components which may be readily and economically fabricated and which provide a relatively long-lived structure.

It is also a further object to provide such a merchandise display hook assembly which enables limited adjustable movement of the display hook between apertures of the panelboard.

SUMMARY OF THE INVENTION

It has now been found that the foregoing and related objects may be readily attained in a merchandise display hook assembly for use in connection with apertured panelboard having a multiplicity of spaced openings on uniform center-to-center spacing. The assembly includes a base member having upper and lower opposed horizontal guide flanges on its front surface which define a transversely extending channel therebetween, and the channel opens on the front surface. The base member also has mounting means extending rearwardly therefrom and engageable in at least one of the openings of an associated panelboard for supporting the assembly thereon. An adapter member has its rearward portion slidably mounted on the flanges and is slidable in the channel of the base member. The channel and adapter member slidable rear portion are cooperatively dimensioned to permit adjustable movement of the adapter member in the channel for a distance equal to not less than one-sixth the length of the adapter member. Cooperating elements on the base and adapter members limit the amount of the adjustable movement of the adapter member to preclude its disengagement from the flanges.

A merchandise supporting hook member has a rearwardly disposed mounting portion engaged in the forward portion of the adapter member, and a forwardly disposed merchandise support portion for supporting merchandise articles placed thereon.

Desirably the base member is integrally formed from sheet metal, and it has at least a pair of horizontally spaced, rearwardly extending fingers along its upper margin providing the engageable means to seat in the panelboard apertures. The base member also has forwardly projecting tabs along its vertical side margins against which the adapter member will abut to limit movement of the adapter member. The rearwardly extending mounting fingers have upwardly extending portions to engage behind the associated panelboard.

The adapter member is integrally molded from synthetic resin and has horizontally extending grooves in the top and bottom surfaces of its rearward portion which seat the guide flanges. The top surface of the front portion of the adapter member has a multiplicity of vertically disposed apertures therein, at least one of which seats the depending mounting portion of the hook member. The top surface also has upwardly opening recesses adjacent the apertures in which is seated at least one horizontally extending section of the mounting portion of the hook member.

BRIEF DESCRIPTION OF THE DRAWINGS

FIG. 1 is a perspective view of a merchandise display hook assembly embodying the present invention, with a fragmentary illustration in phantom line of the mounting or rear portions of the hook member;

FIG. 2 is a front elevational view thereof to an enlarged scale with the forwardly projecting portions of the hook member broken away and member removed;

FIG. 3 is a fragmentary plan view of the subassembly of FIG. 2;

FIG. 4 is a fragmentary side elevational view of the assembly of FIG. 1 showing it as mounted on a panelboard which is shown in phantom line and with the hook member only fragmentarily illustrated;

DETAILED DESCRIPTION OF THE ILLUSTRATED EMBODIMENT

Figure 5:
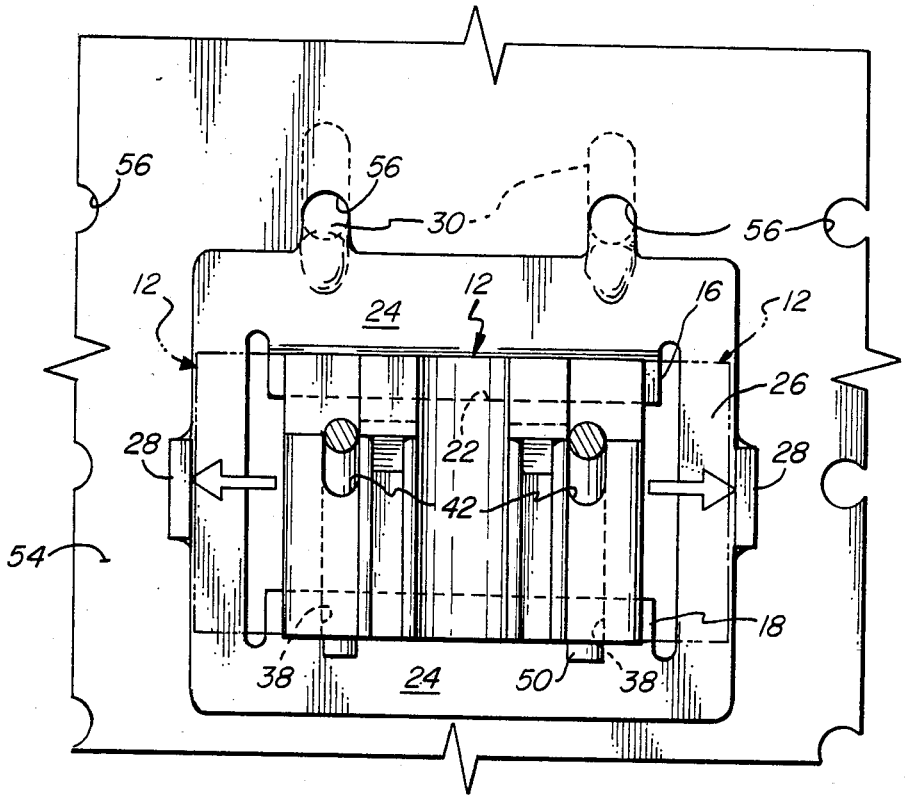
FIG. 5 is a front elevational view of the assembly of FIG. 4 with arrows showing the directions of slidable movement.

Turning now in detail to the attached drawings, therein illustrated in FIGS. 1–5 is a merchandise display hook assembly embodying the present invention and generally comprised of a conventional two prong display hook generally designated by the numeral 10, an adapter member generally designated by the numeral 12, and the base member generally designated by the numeral 14.

The base member 14 is integrally formed by stamping a sheet metal blank to provide a pair of horizontally extending L-shaped rails 16,18 projecting from its front surface and which provide opposed spaced guide flanges 20 defining a channel 22 therebetween. The rails 16,18 extend forwardly from the plane of the panel portion 24 and are spaced rearwardly from its top, bottom and side margins, and bridge portions 26 are defined at the side margins. A pair of forwardly projecting tabs or fingers 28 are provided at the opposed side margins of the bridge portions 26 for a purpose to be described more fully hereinafter. A pair of generally spaced L-shaped lugs or mounting elements 30 extend upwardly and rearwardly from the upper margin of the panel portion 24.

Figure 9:
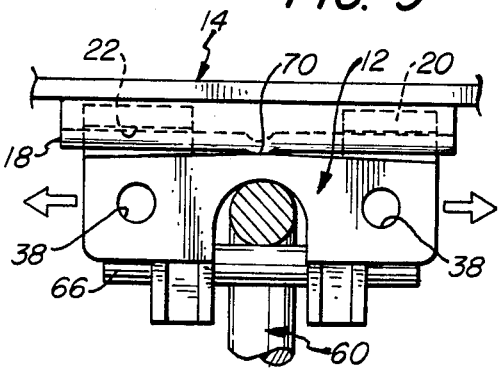
FIG. 9 is a fragmentary bottom view of the subassembly of FIG. 8.

The adapter member 12 is integrally molded from synthetic resin and has a front portion 32 and a rear portion of lesser vertical dimension formed by two generally T-shaped bases 34 providing horizontally extending grooves 36 along the upper and lower edge surfaces. The flanges 20 of the base member 14 slidably seat in the grooves 36 of the adapter member 12 so that it may be guided and retained thereby as it is adjustably moved therealong. The amount of movement is limited by the tabs 28 to ensure that the adapter member 12 remains firmly seated on the guide flanges 20. To provide for retention of the adapter member 12 in an adjusted position, the width of the grooves 36 is dimensioned to snugly seat the flanges 20 and thereby provide some frictional resistance to movement. Moreover, as seen in FIG. 9, the flanges 20 on the base member 14 may be provided with dimples 70 to provide a point of friction. The front portion 32 is of more complex configuration and includes a pair of upwardly opening, generally vertically extending recesses or sockets 38 of circular cross section, formed in a spaced pair of abutments 39 and a multiplicity of generally semicircular grooves 40 aligned therewith and extending to the front surface. Extending in the direction opposite to the grooves 40 and spaced thereabove between the recesses 38 are semicircular grooves 42.

The hook member 10 is a continuous length of wire stock providing two elongated legs 44,46 with a connecting web 48 at the outer end thereof. The inner ends of the legs are bent downwardly as seen in phantom line in FIG. 1 to provide the mounting portions 50. As seen in FIGS. 1–5, the mounting portions 50 seat snugly in the spaced recesses or sockets 48 of the adapter member 12, and the legs 44,46 are cradled in the adjacent grooves 40.

As seen in FIGS. 4 and 5, the assembly of the members 10, 12 and 14 is mounted on a conventional apertured panelboard generally designated by the numeral 54 which has a large number of uniformly spaced apertures 56 aligned in rows and columns. The mounting lugs 30 on the base member 14 extend rearwardly through a pair of spaced apertures 56 and thence upwardly along its rear surface, all as seen in FIG. 4.

Figure 7:
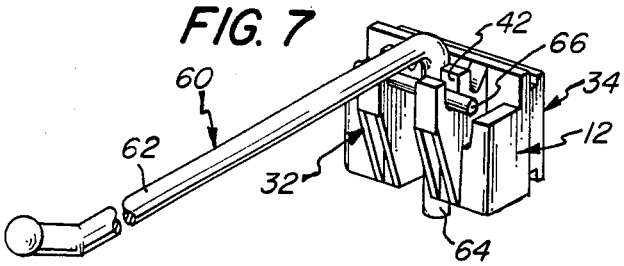
FIG. 7 is a perspective view of the hook member of FIG. 6 seated in the adapter member of FIGS. 1–5.
Figure 6:
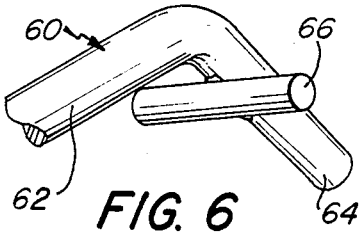
FIG. 6 is a fragmentary perspective view of the mounting portion of a single prong hook member.
Figure 8:
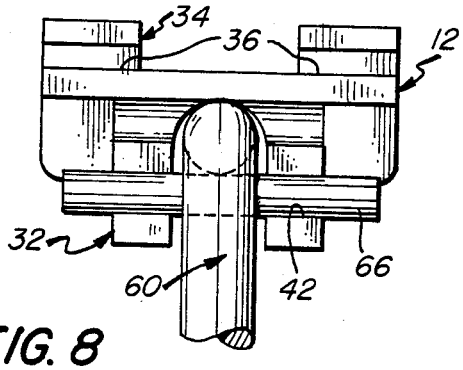
FIG. 8 is a fragmentary plan view of the subassembly of FIG. 7.

Turning now to FIGS. 6–9, a single prong hook member generally designated by the numeral 60 is employed in the assembly. As seen it has a forwardly projecting elongated leg portion 62 and a downwardly bent mounting portion 64 at its rearward end. Extending perpendicularly to its major axis and secured to the mounting portion 64 is the mounting rod 66. As seen in FIGS. 7–9, this hook member 60 is mounted by securely seating the rod 66 in the grooves 42 and causing the depending mounting leg portion to bear against the front surface of the adapter member 12 between the abutments 41.

In assembling the members 12 and 14, one or both of the tabs 28 on the base member 14 are left unbent, i.e., extending in the plane of the panel portion 24. The adapter member 12 is slid onto the base member 14 with the flanges 20 seating in its grooves 36. Thereafter, the tab (or tabs) 28 are bent into the forwardly projecting position seen in the drawings to lock the adapter member 12 in assembly thereon.

To assemble the hook members 10 thereto, the mounting portions 50 are pushed downwardly into the sockets or recesses 38 until the leg portions 44,46 seat snugly in the grooves 40.

To assemble the hook member 60 thereto, the mounting portion 64 is aligned between the abutments 41 and pushed downwardly until the ends of the mounting rod 66 seat firmly in the grooves 42.

As will be readily appreciated, the adapter member 12 may be slid sideways on the base member 14 until it abuts the tabs 28. Thus, the alignment of the hook member 10 (or 60) between a pair of apertures 56 in the panelboard 54 may be varied to utilize more fully the space available hereon for displaying articles being merchandised. Generally, the length of the adapter member 12 relative to the length of the guide flanges 20 and tabs 28 on the base member should provide for a range of movement equal to at least one-fourth, and preferably at least one-half, the center-to-center spacing of the apertures 56 in the panelboard 54. Because these are conventionally one inch on centers, this will provide horizontal adjustability of the positioning of the hook member 10 over a distance of about $\frac{1}{4}$–$\frac{3}{4}$ inch. In terms of the relationship between the base members 14 and adapter member 12, this will generally require relative movement equal to at least $\frac{1}{4}$ the length of the channel 22.

In the illustrated embodiments, the base member has been dimensioned to seat in only a pair of apertures in the panelboard and to provide adjustability over about $\frac{1}{2}$ the spacing between adjacent apertures. If so desired, the assembly may be dimensioned to encompass (and be supported in) more than two apertures in the panelboard and to be dimensioned for a correspondingly greater length of adjustability.

Similarly, more than two socket recesses may be provided to carry or seat two or more hook members, or hook members with a greater number of prongs.

Thus, it can be seen that the merchandise display hook assembly of the present invention enables more efficient use of the display space of a panelboard, and may be assembled rapidly from relatively easily fabricated and economical components.

Having thus described the invention, what is claimed is:

1. A merchandise display hook assembly for use in connection with apertured panelboard having a multiplicity of spaced openings on uniform center-to-center spacing comprising:

(a) a base member having upper and lower opposed horizontal guide flanges on its front surface which define a transversely extending channel therebetween opening on the front surface, said base member having mounting means extending rearwardly therefrom and engageable in at least one of the openings of an associated panelboard for supporting the assembly;

(b) an adapter member having its rearward portion slidably mounted on said flanges and in said channel of said base member, said adapter member having horizontally extending grooves in the top and bottom surfaces of said rearward portion in which are seated said guide flanges, said channel in said base member and said adapted member slidable rear portion being cooperatively dimensioned to permit adjustable movement of said adapter member in said channel for a distance equal to not less than one-sixth the length of said adapter member, said base and adapter members having cooperating elements thereon limiting the amount of said adjustable movement of said adapter member to preclude its disengagement from said flanges; and (c) a merchandise supporting hook member having a merchandise support portion extending forwardly from the upward portion of said adapter member for supporting merchandise articles placed thereon.

2. The display hook assembly of Claim 1 wherein said base member is integrally formed from sheet metal.

3. The display hook assembly of Claim 2 wherein said base member has at least a pair of horizontally spaced, rearwardly extending mounting lugs along its upper margin providing said mounting means.

4. The display hook assembly of Claim 2 wherein said base member has forwardly projecting tabs along its vertical side margins against which said adapter member will abut to provide said elements limiting movement of said adapter member.

5. The display hook assembly of Claim 3 wherein said rearwardly extending mounting lugs have upwardly extending portions to engage behind the associated panelboard.

6. The display hook assembly of Claim 1 wherein said hook member is separately formed with said merchandise support portion and a rearwardly disposed mounting portion engaged in the forward portion of said adapter member.

7. The display hook assembly of Claim 6 wherein the top surface of the front portion of said adapter member has a multiplicity of vertically disposed apertures therein, at least one of which seats said mounting portion of said hook member.

8. The display hook assembly of Claim 7 wherein said top surface has upwardly opening recesses adjacent said apertures seating at least one horizontally extending section of said mounting portions of said hook member.

9. A merchandise display hook assembly for use in connection with apertured panelboard having a multiplicity of spaced openings on uniform center-to-center spacing comprising:

(a) a base member integrally formed from sheet metal with front and rear portions and having upper and lower opposed horizontal guide flanges on its front surface which define a transversely extending channel therebetween opening on the front surface, said base member having mounting means on its rear portion extending rearwardly therefrom and engageable in at least one of the openings of an associated panelboard for supporting the assembly;

(b) an adapter member integrally molded from synthetic resin with front and rear portions and having its rearward portion slidably mounted on said flanges and in said channel of said base member, said adapter member having horizontally extending grooves in the top and bottom surfaces of said rear portion seating said guide flanges, said channel in said base member and said adapter member slidable rear portion being cooperatively dimensioned to permit adjustable movement of said adapter member in said channel for a distance equal to not less than one-sixth the length of said adapter member, said base and adapter member having cooperating elements thereon limiting the amount of said adjustable movement of said adapter member to preclude its disengagement from said flanges; and (c) a merchandise supporting hook member having a rearwardly disposed mounting portion engaged in the forward portion of said adapter member and a forwardly disposed merchandise support portion for supporting merchanise articles place thereon.

10. The display hook assembly of Claim 9 wherein said base member has at least a pair of horizontally spaced, rearwardly extending mounting lugs along its upper margin providing said engageable mounting means, and forwardly projecting tabs along its vertical side margins against which said adapter member will abut to provide said elements limiting movement of said adapter member.

11. The display hood assembly of Claim 10 wherein said rearwardly extending mounting lugs have upwardly extending portions to engage behind the associated panelboard.

12. The display hook assembly of Claim 10 wherein the top surface of said front portion of said adapter member has a multiplicity of vertically disposed apertures therein, at least one of which seats said mounting portion of said hook member.

13. The display hook assembly of Claim 12 wherein said top surface has upwardly opening recesses adjacent said apertures seating at least one horizontally extending section of said mounting portions of said hook member.

* * * * *